US007820932B2

(12) United States Patent
Stemmle

(10) Patent No.: US 7,820,932 B2
(45) Date of Patent: Oct. 26, 2010

(54) MAIL SORTER, METHOD, AND SOFTWARE PRODUCT FOR A TWO-STEP AND ONE-PASS SORTING ALGORITHM

(75) Inventor: Denis J. Stemmle, Stratford, CT (US)

(73) Assignee: Lockheed Martin Corporation, Bethesda, MD (US)

( * ) Notice: Subject to any disclaimer, the term of this patent is extended or adjusted under 35 U.S.C. 154(b) by 781 days.

(21) Appl. No.: 11/519,630

(22) Filed: Sep. 12, 2006

(65) Prior Publication Data

US 2008/0011653 A1 Jan. 17, 2008

Related U.S. Application Data

(60) Provisional application No. 60/831,162, filed on Jul. 13, 2006.

(51) Int. Cl.
*B07C 5/00* (2006.01)

(52) U.S. Cl. ..... 209/583; 209/584; 209/900

(58) Field of Classification Search ..... 209/583, 209/584, 900

See application file for complete search history.

(56) References Cited

U.S. PATENT DOCUMENTS

| | | | |
|---|---|---|---|
| 3,420,368 | A | 1/1969 | Sorrells |
| 3,452,509 | A | 7/1969 | Hauer |
| 3,587,856 | A | 6/1971 | Lemelson |
| 3,757,939 | A | 9/1973 | Henig |
| 3,889,811 | A | 6/1975 | Yoshimura |
| 3,901,797 | A | 8/1975 | Storace |
| 3,904,516 | A | 9/1975 | Chiba |
| 3,933,094 | A | 1/1976 | Murphy |
| 4,008,813 | A | 2/1977 | Leersnijder |
| 4,058,217 | A | 11/1977 | Vaughan |
| 4,106,636 | A | 8/1978 | Ouimet |
| 4,169,529 | A | 10/1979 | Hunter |
| 4,244,672 | A | 1/1981 | Lund |
| 4,507,739 | A | 3/1985 | Haruki |
| 4,627,540 | A | 12/1986 | Takeda |

(Continued)

FOREIGN PATENT DOCUMENTS

| | | |
|---|---|---|
| JP | 1159088 | 6/1989 |

(Continued)

OTHER PUBLICATIONS

"Development of in-process skew and shift adjusting mechanism for paper handling," American Society of Mechanical Engineers http://www.directtextbook.com, 1998.

*Primary Examiner*—Stefanos Karmis
*Assistant Examiner*—Terrell H Matthews
(74) *Attorney, Agent, or Firm*—Leland Schultz; Roberts Mlotkowski Safran & Cole, P.C.

(57) ABSTRACT

A sorter, method, and software product are used for sorting objects into a sequence of destination addresses, in at most a single pass through the sorter. In a first stage of the single pass through the sorter, the objects are sorted into a plurality of batches corresponding to groups of the destination addresses. The batches are then eventually advanced from the first stage to a second stage of the single pass through the sorter. During that second stage, objects in each of the batches are sorted into the sequence of destination addresses.

30 Claims, 9 Drawing Sheets

U.S. PATENT DOCUMENTS 4,641,753 A 2/1987 Tamada
4,688,678 A 8/1987 Zue
4,738,368 A 4/1988 Shaw
4,868,570 A 9/1989 Davis
4,874,281 A 10/1989 Bergerioux
4,891,088 A 1/1990 Svyatsky
4,895,242 A 1/1990 Michel
4,921,107 A 5/1990 Hofer
4,923,022 A 5/1990 Hsieh
4,965,829 A 10/1990 Lemelson
5,031,223 A 7/1991 Rosenbaum
5,042,667 A 8/1991 Keough
5,077,694 A * 12/1991 Sansone et al. ..... 707/104.1
5,119,954 A 6/1992 Svyatsky
5,186,336 A 2/1993 Pippin
5,291,002 A 3/1994 Agnew
5,470,427 A 11/1995 Mikel
5,480,032 A 1/1996 Pippin
5,667,078 A 9/1997 Walach
5,718,321 A 2/1998 Brugger
5,981,891 A 11/1999 Yamashita
6,126,017 A 10/2000 Hours
6,227,378 B1 5/2001 Jones
6,276,509 B1 8/2001 Schuster
6,347,710 B1 2/2002 Ryan
6,365,862 B1 4/2002 Miller
6,403,906 B1 6/2002 De Leo
6,435,353 B2 8/2002 Ryan
6,443,311 B2 9/2002 Hendrickson
6,550,603 B1 4/2003 Beach
6,561,339 B1 5/2003 Olson
6,561,360 B1 5/2003 Kalm
6,677,548 B2 1/2004 Robu
6,762,384 B1 7/2004 Kechel
6,814,210 B1 11/2004 Hendzel
6,897,395 B2 5/2005 Shiibashi
6,946,612 B2 9/2005 Morikawa
6,953,906 B2 10/2005 Burns
6,994,220 B2 2/2006 Schererz
7,004,396 B1 2/2006 Quine
7,111,742 B1 9/2006 Zimmermann
7,112,031 B2 9/2006 Harres
7,138,596 B2 11/2006 Pippin
7,170,024 B2 1/2007 Burns
7,210,893 B1 5/2007 Overman
7,227,094 B2 6/2007 Oexle
7,235,756 B2 6/2007 De Leo
7,259,346 B2 8/2007 Svyatsky
7,304,259 B2 * 12/2007 Schwarz et al. ..... 209/584
7,304,260 B2 12/2007 Boller
7,378,610 B2 5/2008 Umezawa
7,388,168 B2 * 6/2008 Chamblee et al. ..... 209/584
7,396,011 B2 7/2008 Svyatsky
7,397,010 B2 * 7/2008 Wilke ..... 209/584
7,397,011 B2 7/2008 Berdelle-Hilge
2002/0053533 A1 5/2002 Brehm
2002/0125177 A1 9/2002 Burns
2002/0139726 A1 10/2002 Roth et al. ..... 209/584
2003/0006174 A1 1/2003 Harres
2003/0045945 A1 3/2003 Lopez
2003/0136713 A1 7/2003 Lopez
2003/0155282 A1 8/2003 Kechel
2003/0208298 A1 11/2003 Edmonds
2003/0209473 A1 11/2003 Brinkley
2004/0007510 A1 1/2004 Kechel
2004/0251179 A1 * 12/2004 Hanson et al. ..... 209/584
2004/0261367 A1 12/2004 Roth
2005/0025340 A1 2/2005 Hickman
2005/0071288 A1 * 3/2005 Sansone et al. ..... 705/401
2005/0096783 A1 5/2005 Mileaf
2005/0216118 A1 * 9/2005 Conard et al. ..... 700/223
2005/0222708 A1 10/2005 Wisniewski
2006/0016738 A1 1/2006 Norris
2006/0070929 A1 4/2006 Fry
2006/0108266 A1 * 5/2006 Bowers et al. ..... 209/584
2006/0124512 A1 6/2006 Quine
2006/0180520 A1 8/2006 Ehrat
2006/0191822 A1 8/2006 Avant
2007/0090029 A1 4/2007 Avant
2007/0131593 A1 6/2007 Burns
2007/0272601 A1 11/2007 Cormack
2008/0011653 A1 1/2008 Stemmle
2008/0012211 A1 1/2008 Stemmle
2008/0027986 A1 1/2008 Stemmle
2008/0093273 A1 4/2008 Stemmle
2008/0093274 A1 4/2008 Stemmle
2008/0164185 A1 7/2008 Stemmle

FOREIGN PATENT DOCUMENTS

JP 1271789 10/1989
WO 01/08817 8/2001

* cited by examiner

MAIL SORTER, METHOD, AND SOFTWARE PRODUCT FOR A TWO-STEP AND ONE-PASS SORTING ALGORITHM

RELATED APPLICATIONS

This application claims the benefit of U.S. Provisional Application No. 60/831,162 filed Jul. 13, 2006.

TECHNICAL FIELD

The present invention relates generally to mail sorting, and more particularly to escorted mail sorting.

BACKGROUND OF THE INVENTION

It is known to load mail pieces into clamps and then sort the mail pieces by interacting only with the clamps. A major benefit of such a sorter is to enable sorting a much wider latitude of mail piece types than can be sorted using current technology. The following related patent applications are incorporated herein by reference, in their entirety: U.S. Provisional Application No. 60/669,340 (filed 7 Apr. 2005), and also International Application US06/12861 (filed 7 Apr. 2006) which claims priority to the U.S. provisional application.

There are many ways that this sorting concept could be applied to mail processing applications. Those applications include using inward or outward sort algorithms to sort single types of mail (e.g. letters, flats, newspapers, or non-machineable mail), or merging these mail streams together and sorting. Many posts around the world continue to seek a more effective mail merging system that automatically merges all mail streams and sorts them to delivery sequence. The system should accomplish this merging at the step of carrier sequence sorting by merging all elements of the mail stream (letters, flats, periodicals, post cards etc) at the final sorting process. There continues to be a need to refine and optimize sorting configurations and algorithms to complete the task of sorting multiple routes of mail within finite time windows available at the posts. Typically, the posts would like to sort 20 to 30 routes of mail within a two-hour time frame.

At present, some of the mail streams arrive at the postal branch offices pre-sorted, and some do not. Generally, even when the mail arrives at the branch already sorted by delivery sequence, postal carriers need to merge multiple streams of mail (often as many as ten streams) from different mail trays—and for this the postal carriers generally use a manual sorting process. When mail does not arrive at the branch pre-sorted, the carriers spend even more time—several hours—sorting the mail into carrier delivery sequence manually. Often, the carrier on mechanized routes will complete the mail merging while sitting at each post box—merging mail from multiple mail trays on the spot before placing it in the mailbox. This requires carriers to spend substantial time merging and sorting the mail before they can start to deliver it, or else they must complete the merging while they are delivering the mail, thus making the mail delivery process (the last mile) quite inefficient.

The 2003 Presidential Commission Report on the Future of the United States Postal Service (USPS) concluded that the Postal Service should continue to develop an effective merging system that is responsive to customer needs and culminates in one bundle of mixed letters and flats for each delivery point. The system should accomplish this merging at the step of carrier sequence sorting by merging all elements of the mail stream (letters, flats, periodicals, post cards etc) at the final sorting process.

The sorters available on the market today have significant limitations: they are either huge, expensive pieces of equipment with a very large number of bins, and require significant space to operate; or they have a smaller number of bins, but require multiple passes to operate. This multi-pass operation is a very labor-intensive process. So, for example, a sorter with 16 bins, sorting a job to 2000 addresses, will require three passes. That means the operator must load the mail, operate the sorter, then unload the mail from each bin and re-load it into the feeder three times. While this results in some time savings compared to manual sorting, the value proposition is limited because of the high labor content. See, for example, U.S. Pat. No. 6,555,776 entitled "Single Feed One Pass Mixed Mail Sequencer," filed 2 Apr. 2001 and issued 29 Apr. 2003.

International Application US06/12861 involves a clamp-based sorting system having a sort-to-route module as well as a sort-to-delivery-sequence module, in order to simultaneously sort inbound and outbound mail. However, International Application US06/12861 does not disclose any way to efficiently sort inbound mail that has already been sorted to route, and does not disclose a way to efficiently sort to any other degree of fineness. For example, in order to sort mail for one route to delivery sequence using the sort-to-delivery sequence modules, the equivalent of 800 address stations was assumed. That configuration has high productivity, but also high cost. Moreover, International Application US06/12861 requires that all the mail for the entire route must be read before starting the sorting step, which means that all this mail needs to be stored somewhere for a period of time prior to sorting. Thus, according to International Application US06/12861, the inbound mail is sorted to route and stored for a long time (up to a whole shift of 8 hours) before being recycled for a second pass through the sorter in the sort-to-delivery-sequence step. All the mail from each route must be read before the final sorting step (sort to delivery sequence) is started. Inherent in that related art approach is the same limitation: all the mail pieces for a route must be read before the sorting step can be started.

Each morning before delivering the mail, a postman normally will manually merge all the separate mail streams together, and sort them to delivery sequence. Typically, this task takes 2.5 to 3 hours to complete. It is also possible to do this job using two types of automated sorter configurations, such as the clamp-based systems mentioned above. One configuration has, for example, 80 address stations, while the second configuration has 800 address stations. For both of these configurations, all the mail for a specific route must be fed, read, and clamped before sorting begins. This is because the sorter controller needs to know the number of pieces destined for each address before assigning the temporary addresses to the individual sorting stations. Typically, the sort station would have a limited capacity for storing mail pieces. For example, in European routes, each address receives an average of 2.5 mail pieces per day. So, the sorter might be designed in such a way that each sorting station has the capacity to store 5 mail pieces. If any address is to receive more than 5 pieces on a particular day, the controller knows this before the sorting step begins, and simply assigns two or more adjacent sorting stations to that address. In this way, all of the mail can be sorted to delivery sequence without special handling for exceptions. If an address receives no mail pieces, the controller does not assign a sort station for that address. In this way, the total sorting path can be kept relatively short. An alternative would be to increase the storage capacity of each sort station to minimize the chances that on any day the capacity will be exceeded—but there will always be exceptions. And this approach makes the sorting path longer, and lengthens total job time for sorting.

In the first of the two types of automated sorter configurations, the unsorted mail makes multiple passes around a race track path. During each pass around the race track, the system controller assigns temporary address identifications to each sort station. As the unsorted mail is transported around the race track, all the mail pieces destined for the temporarily assigned addresses are diverted to the sort stations. The race track shaped path for unsorted mail in the 80 address station configuration has the capacity to transport 1500 mail pieces (for 600 addresses at 2.5 pieces per address) around a race track path for unsorted mail. During the first pass around the race track path, the mail for only the first 80 addresses would be diverted to the address stations. When the last of the unsorted mail passes the divert stations, the sorted mail is moved on a second path toward an unloading station. These emptied address stations are then assigned the next 80 addresses on the route. When the unsorted mail makes a second pass, the mail for the second 80 addresses is diverted to the address stations. This sorted mail is then cleared out of the second path and moved toward the unloading station, and the unsorted mail is transported past the 80 stations a third time, fourth time, et cetera—each time with the 80 sorting stations assigned a new batch of 80 addresses, until mail to all 600 addresses has been sorted. In this example, the unsorted mail will make 7.5 cycles around the inner path.

This first configuration is one of the lowest cost sorting options, but not a good option if fast job time is required. It takes about 30 minutes to sort one route's worth of mail. This is 5 to 6 times faster than the postman can sort the equivalent volume. But, it will take this sorter ten hours to sort 20 routes of mail—a typical application. Generally, posts only allow 2 to 3 hours to complete this job, and therefore 4 or more sorters would be required to sort every 20 routes total job within the time available.

The second alternative configuration completes sorting 20 routes' worth of mail in about 2 hours. This configuration has 800 diverters and temporarily assignable address stations, and multiple feed/read/clamp systems to input the mail into the sorter. With 800 diverters in the sorting path, each batch of unsorted mail (1500 pieces per route) will make only one pass through the sorter. The temporarily assignable address stations will need to be assigned addresses only once per route. And as soon as the last of the unsorted mail for any route's worth of mail passes by a diverter to an address station, that (sorted) mail can be moved by the second path toward an unload station—thereby making the addressing stations sequentially available for reassignment of new address destinations for the next route. In this situation, the mail for a second route can be fed in shortly after the last piece of the first route's mail has entered the sorter. And a third route's worth of mail can enter right behind the second, and so forth. Each batch of mail makes only a single pass through the sorter, and all the mail is sorted to 600 to 800 addresses on a single pass.

According to these two related art configurations, all the mail pieces for a route would be loaded in the sorter, scanned, and put into clamps before the first piece was actually sorted. This allows the database management system to determine how many pieces of mail are destined for each address, and to calculate the total accumulated thicknesses of all the mail pieces destined for each address. With that information, the controller could then determine if one address station was sufficient to hold the mail to be delivered that day for each address. For example, in Europe, each address along a route receives an average of 2.5 mail pieces per day. So, it was assumed that the address stations would be designed with a capacity to hold 5 mail pieces. The sorter was designed for the clamps to fit onto a drive mechanism at fixed pitches of 0.2". So, if all the mail pieces had thicknesses below the 0.2" pitch, then each address station could hold five mail pieces. If there were some pieces that were thicker than the 0.2" pitch, then two or more pitches would be assigned to that piece. Thus, for example, a 5 pitch storage system could handle five thin pieces, or three thin pieces and a thicker piece that required two pitches to store, or one thin piece, and two thicker pieces that each required two pitches to store, or a single thick piece that required all five pitches to store . . . and many other combinations. Since the controller counts the number of pieces and measures the thickness of each piece while they are being loaded into the clamps prior to the sorting operation, the controller can determine if the combination of the number of pieces and the accumulated thickness of the pieces destined for a particular address will exceed the storage capacity of an address station. If more than one address station is required to handle the mail for a particular address, the controller would assign two or more adjacent stations to handle the mail for that address during the sorting operation—and thereby keep the mail in delivery sequence order. That is why (in the above examples), for routes with an average of 600 addresses, a total of 800 addressing stations were provided—to handle heavy mail days. Reading the addresses for all the mail in a particular route, before starting to sort the mail, makes it possible for the controller to not assign an address station to an address for which no mail is destined.

The first of the two configuration described above had 80 diverters, and required a relatively long job time, but the cost was relatively low. In the second configuration with 800 diverters, the job time is quite fast, but the cost of the sorter increases approximately by a factor of at least ten. It would be highly desireable to somehow combine the low cost of the first configuration with the speed of the second configuration.

The architectures of the above-described configurations are not particularly space-efficient. Each address station requires two types of spaces: a blank space at the beginning of each address station to keep an open gap to allow mail pieces to be moved into the address storage area without colliding with mail pieces that are already there.

Typically, 3" or 15 pitches of open area are required to prevent collisions with incoming mail pieces. Furthermore, space is needed for storing the mail being sorted to that address. If a system is designed to store 5 mail pieces at 0.2"/pitch, this will add another inch of space. So the total space for each address station will be 4". If the storage capacity is increased from 5 to 10 pieces, another inch of storage space will be required, and the total space will be 5". It is obvious that the need to have the 3" of empty space for moving mail pieces to each of the address storage areas makes the sorting stations quite inefficient in space usage. The need to read all the mail for a particular route before starting the sorting operation has a disadvantage of requiring storage space for the average of 1500 pieces per route after the mail is clamped, but before the sorting operation begins.

SUMMARY OF THE INVENTION

A sorter configuration and sorting algorithm are presented in order to simultaneously optimize the cost and performance of a mail sorter by sorting the mail pieces using two stages in a single pass. The first stage is to sort the mail pieces to a batch of addresses (e.g. 25 addresses) during a first portion of the sorting path. The second stage is to sort each batch to the (e.g. 25) individual addresses in delivery sequence, during a second portion of the sorting path. This single pass system can merge all mail together before it is sorted to delivery sequence.

Generally speaking, since sorter cost is roughly proportional to the number of diverters and assignable address stations, the sorter with the smallest number of diverters and address stations will have the lowest cost. For the fastest job time, it is desirable to move the mail through the sorter only once to complete the total sorting job, and to keep the total path length as short as possible to reduce total job time. This is because the transport speeds through the sorter are very slow (2 in/sec). For the fastest job time, it is also desirable to perform steps of feed/read/clamp operations as well as the sorting operations in an overlapping fashion rather than wait until the first operation (feed/read/clamp) is complete, before starting the second operation of sorting.

The new sorting algorithm described herein, for use in a clamp-based or other sorter configuration, can sort mail to delivery sequence in a single pass, the sorter having substantially fewer diverter and assignable address station assemblies than the number of destinations, and substantially shorter total path length compared to previous configuration—which reduces the total job time. In addition, with this disclosed sorting algorithm, the need to scan all mail pieces before starting the sorting step is eliminated, thereby reducing total job time and simplifying the operation of the sorter.

This new configuration and algorithm dramatically reduces the cost of the sorter while simultaneously reducing the job time by at least forty percent (40%) compared to previously disclosed configurations. It also eliminates the need to read all the mail pieces before starting the sorting operations, which further reduces overall job times.

Although sorting in a single pass is not new, sorting in one pass using two phases (phase 1 being sort to batch, phase 2 being sort to address) is new when done in a single pass. Moreover, according to the present invention, each mail piece is passed by an image capture device (reader) to ascertain the destination by reading and interpreting the address, but the sorting step begins before all of the mail pieces for the entire route are read. So, all the mail for a route does not need to be stored anywhere for a period of time prior to commencement of sorting.

For a racetrack configuration with 80 address stations, the mail is simply loaded into an inner path without sorting during the reading step. The need to load and store all the mail before sorting the mail would add to the total job time—because the mail needs to be transported around the racetrack one additional time before the actual sorting job is started. The disclosed algorithm of sorting in two steps in a single trip through the sorter has the effect of eliminating the need to read all the mail before starting the sorting operation—which reduces job time, and reduces the total path length through the sorter.

BRIEF DESCRIPTION OF THE DRAWINGS

The accompanying drawings illustrate presently various embodiments of the invention, and assist in explaining the principles of the invention.

DETAILED DESCRIPTION OF AN EMBODIMENT OF THE INVENTION

Figure 1:
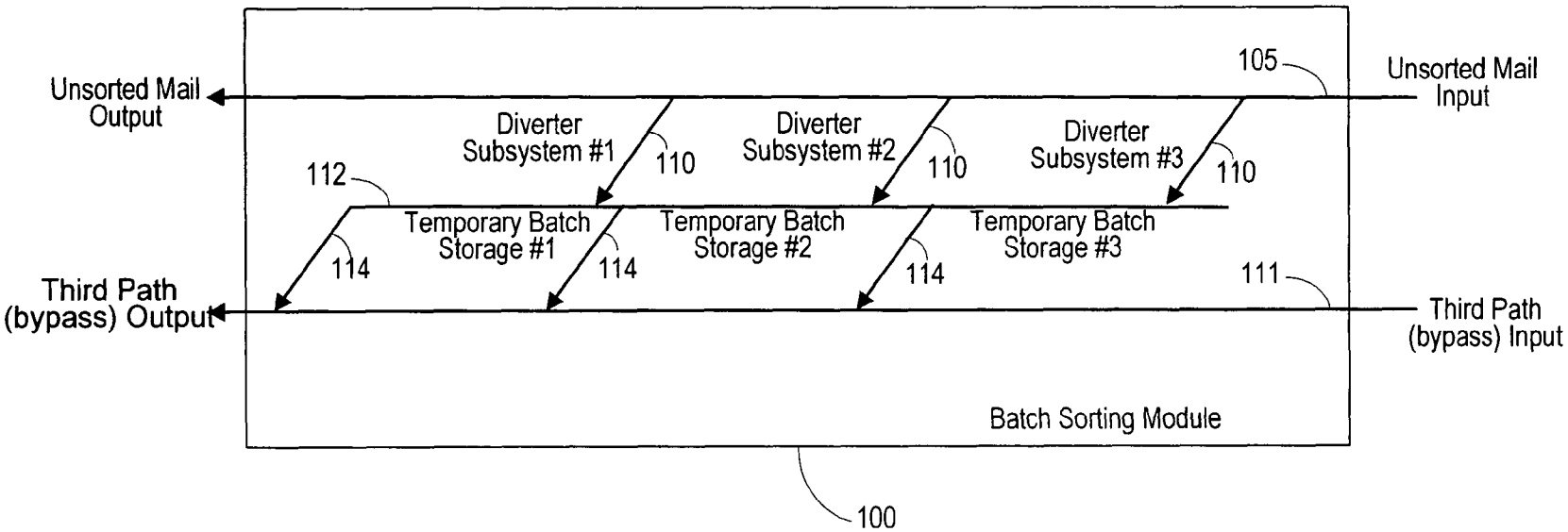
FIG. 1 shows a batch sorting module according to an embodiment of the present invention.

An embodiment of the present invention will now be described, and it is to be understood that this description is for purposes of illustration only, and is not meant to limit the scope of the claimed invention. According to this embodiment of a mail sorting system, each mail piece is singulated, scanned, then captured by a clamp. The information read during the scanning operation (which may include addresses, barcodes, mail piece weight and dimensions, and other information) is associated in a database with a unique identifier on the clamp holding the mail piece, i.e., on the holder for the mail piece. From that point on, all mechanical operations act on the clamp, and the mail piece is not touched by either the operator or the sorter equipment. Because all the clamps are substantially identical in shape and composition, they can be manipulated by the machinery with a high degree of reliability. The present system is capable of handling the entire diversity of the shapes, sizes and weights of mail stream with a consistent reliability.

As the mail is initially read and clamped, it is simultaneously moved into the sorter and sorted to batches of 25 addresses. So, the need to read all the mail before starting the sorting operation is eliminated. The step of sorting to discrete groups of destination addresses (e.g. batches of 25 addresses) also makes the total sorting path considerably shorter and more efficient. In previous configurations, twice the space required for the average number of pieces per address was assumed for each address station. It is probable that on any given day, many addresses on each route will receive more than the average amount of mail, and many will receive less. By pooling 25 addresses together, the sum of all mail to those 25 addresses is more likely to be close to the average. Therefore, the buffer at each sort station can be designed to accommodate heavy mail days based on historical variations in mail volumes. So, for example, if the average number of pieces per address is 2.5, and the historical seasonal variation in mail volumes is 50% increase, then it would be prudent to provide space to store $(25\times2.5)\times1.5=94$ pieces. This is less than the double space at each address station previously assumed.

Perhaps the biggest benefit of the batch storage strategy of this embodiment of the invention is that only one 3" open space is required for moving mail to the storage area for each 25 addresses, not 3" for each address. So, the total path length is reduced by 72" for each 25 addresses. For a system that accommodates 600 addresses, the path length is reduced by 1728". This shorter path significantly reduces the total job time because the mail will not have to travel as far. At 2 in/sec, the job time can be reduced by about 15 minutes because the path length is shortened by the 1728".

By first sorting to batches of 25 addresses, the need to read all the mail before sorting it is eliminated, saving both time and space. And daily variations in volume for each address can be averaged out rather than accommodated on a per-address basis. Also, having read, clamped, and sorted all the mail to batches of 25, the number of address stations required to accommodate the mail volume for each address can be determined by the controller prior to moving the mail to the second phase—sorting the batches into individual addresses in the correct sequence. If any address needs more address stations to accommodate a heavy mail day, the controller can assign the correct number of address stations after the sort-to-batch step is completed. So, the advantage of assigning adjacent sort-to-address stations in order to keep all the mail in the delivery sequence is preserved—it is just applied later in the process.

It will be noted that during the second stage, at least 25 individual address stations are required. This second stage operation is repeated for each batch of 25 addresses sorted in the first phase one after the other. As the first batch of 25 addresses moves through the second phase, the controller assigns the address stations with the correct sequence of addresses, and the batch of 25 addresses is sorted to the address level. This sorted mail is moved into an unloader subsystem, and the controller assigns the next batch of 25 addresses to the address stations so that the second batch of 25 addresses can be immediately moved through phase 2. This pattern continues until all the batches of 25 are sorted to address and moved into the unload subsystem.

It will also be noted that an absolute minimum of 24 batch sort stations will be needed to handle a route of 600 addresses, and another 25 address sorting stations will required for phase 2. This gives a minimum of 49 total address stations, substantially fewer than the 800 address stations needed in the previous example. A more practical system may have a few extra of each type of sort station to accommodate larger routes and particularly heavy mail days.

There are at least two types of sorting modules used in this embodiment of the invention: batch sorting modules and address sorting modules. The first sorting modules in the sorting path will be the batch sorting modules.

FIG. 1 shows a batch sorting module 100 according to an embodiment of the present invention. The batch sorting module will accept a queue of clamped mail from the input systems, and will also accept information on the clamp identities and instructions for the disposition of each clamp (and mail piece) from the master controller. The batch sorting module will read clamp identities as they enter the sorting module.

Each batch sorting module will have a first path 105 (i.e. unsorted path) for transporting clamped unsorted mail; the input to this path is a queue of clamped mail handed off from an upstream module, and the outputs include three diverter stations to move the mail sideways off the transport, and a means to hand the unsorted mail off to a sorter module or an output module downstream.

Each batch sorting module will have, for example, three diverter subsystems 110 to move mail from the unsorted path 105 to respective temporary batch storage stations 112. The diverter subsystems will have three major sub-components. First, a diverter subsystem will have a means to move one clamp off the unsorted mail transport and onto a diverter transport without disturbing the clamp before or after the diverted clamp on the unsorted mail transport. The actuator for this mechanism will be responsive to commands from the module controller. The cycle time for the diverting mechanism will be sufficient to enable diverting of either single or adjacent clamps onto the diverting transport. Second, a diverter subsystem will have a transport for transporting diverted clamps from the unsorted mail path to the temporary batch storage area. It is expected that this transport will be positioned at an angle from the unsorted path such that the component of velocity parallel to the unsorted path will match the speed of the unsorted path. Hence, the relative motion between the mail pieces is limited to mail moving sideways out of the queue of unsorted mail. Third, a diverter subsystem will have a means to transfer the clamps from the diverting transport to the batch storage transport.

According to this embodiment, each batch sorting module may have three (3) temporary batch storage transports (or stations) for storing batches of mail. There are as many as two inputs to each batch storage transport: the diverter transport 110 carrying clamps from the unsorted mail path 105, and clamps handed off from an upstream batch storage transport. Likewise, there are as many as two outputs for each batch storage transport: an output 114 to the third path/exit transport 111, and an output to a downstream batch storage transport.

The operation of the batch storage transport will be intermittent; it will advance all mail pieces stored whenever a new piece has been added from either of the two inputs. The storage capacity of each batch storage transport may be a maximum of 115 clamps each holding mail pieces 2 mm thick or less. The capacity will be reduced when the batch being stored contains thicker mail pieces. The intent of this capacity target is to satisfy two objectives: first, capacity to hold mail for 25 addresses on European routes, each address receiving an average of 2.5 mail pieces per day, the average thickness of each piece being 1.3×the standard pitch of 0.2 inches and, second, and capacity that allows 40% excess capacity for high volume mail days.

As mentioned, each batch sorting module will have a third path (i.e. batch output path) 111 for advancing clamped mail past downstream batch storage transports, directly to other modules down stream such as the address sorting modules or the stacker modules. The third path transports will accept clamped mail from any of the three batch storage transports, or from the third path in an upstream module. The third path will transfer the clamped mail to the input of the third path on the next downstream module. The third path speed will be compatible with the rate of transferring clamped mail onto the transport. The third path will preferably operate at continuous speed. Mail will be transferred to the third path under the following conditions: for the merge and sequence operation, when the last clamp having unsorted mail passes the diverter station associated with the batch storage transport, the clamped mail stored on the batch storage transport can be transferred to the third path. This empties the batch storage transport so that the next route's mail can be started down the unsorted mail path. Note the possibility that the unsorted path may be utilized as (or transformed into) the batch output path once all of the mail pieces have been diverted from the unsorted path.

Figure 2:
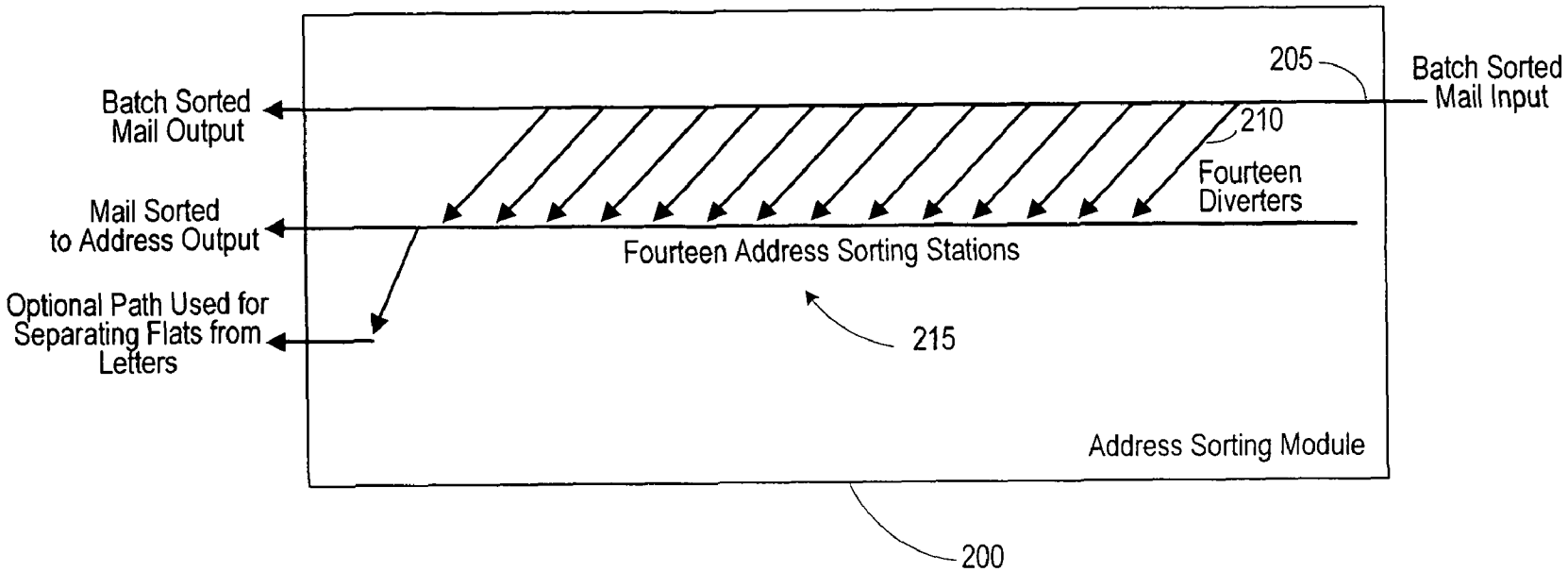
FIG. 2 shows an address sorting module according to an embodiment of the present invention.

As mentioned, there are two types of sorting modules used in this embodiment of the invention: batch sorting modules and address sorting modules. According to this embodiment of the invention, the last two sorting modules in the sorting path will be the address-sorting modules. FIG. 2 shows an address sorting module 200 according to this embodiment of the present invention. These address sorting modules will have the following functions and characteristics.

The address sorting module will accept sequential batches of clamped mail from the third path 111 of the upstream batch sorting module 100 shown in FIG. 1, and will also accept information on the clamp identities and instructions for the disposition of each clamp (and mail piece) from the master controller. The address sorting module 200 will read clamp identities as they enter the sorting module.

Each address sorting module will have a first path 205 for transporting clamped unsorted mail, which is either aligned with the third path of the upstream module when the upstream module is a batch sort module, or with the first path when the upstream module is an address sorting module. The input to this first path of the address sorting module is a batch of clamped mail handed off from an upstream module, each batch containing mail destined for 25 addresses. The outputs to this first path of the address sorting module include fourteen diverter stations, in order to move the mail sideways off the transport, and a means to hand the partial batches of mail to a second address sorter module downstream.

Each address sorting module will have fourteen diverter subsystems 210 to move mail from the first mail path 205 to the fourteen assignable address stations 215. These diverter subsystems will operate identically to the three diverter systems designed for the batch sorting modules, and preferably have identical components.

Moreover, each address sorting module will have fourteen mail storage transports for storing mail destined for each address. There are two inputs to each of these address storage transports: the first input is a diverter transport carrying clamps from the first (batch) mail path, and the second input includes clamps handed off from an upstream address storage transport. The single output for each address sorting transport will pass the mail onto the next address storage transport—which may be the first address storing transport in the next module. The last address storing transport will hand the mail off to an output (de-clamping or stacking) module. The address sorting module may include a second output path that may be used for sorting flats from letters.

The storage capacity of each address storage transport will be a maximum of 10 clamps each holding mail pieces 0.2 inches thick or less. The capacity will be reduced when the batch being stored contains thicker mail pieces. The intent of this capacity target is to accommodate European routes where each address receives an average of 2.5 mail pieces per day. The 10 pitch storage system will accommodate heavy mail days of up to 10 of the thinnest pieces per address, or will accommodate heftier average thickness of each piece being up to 1.0 inches thick, (or some combination of these two possibilities.) Note that this storage capacity for each address station is four times the average mail to be sent to each address each day.

A total of 28 address stations are provided to sort mail previously batched for 25 addresses; these address stations are provided by two address sorting modules per sorting system, each sorting module having a 14-address sorting capability. Thus, three address stations can be used as overflow for specific addresses that receive more than the ten-piece maximum storage capability of the single address station. When two adjacent storage modules are joined together, the maximum storage capability will be increased from 10 to 35 mail pieces per address, because only one 3 inch entry space is required for the two stations, and the 3 inch space normally used as the entry area of the second assigned station can temporarily be used for storage of the mail destined for the assigned address of the combined stations.

Figure 3A:
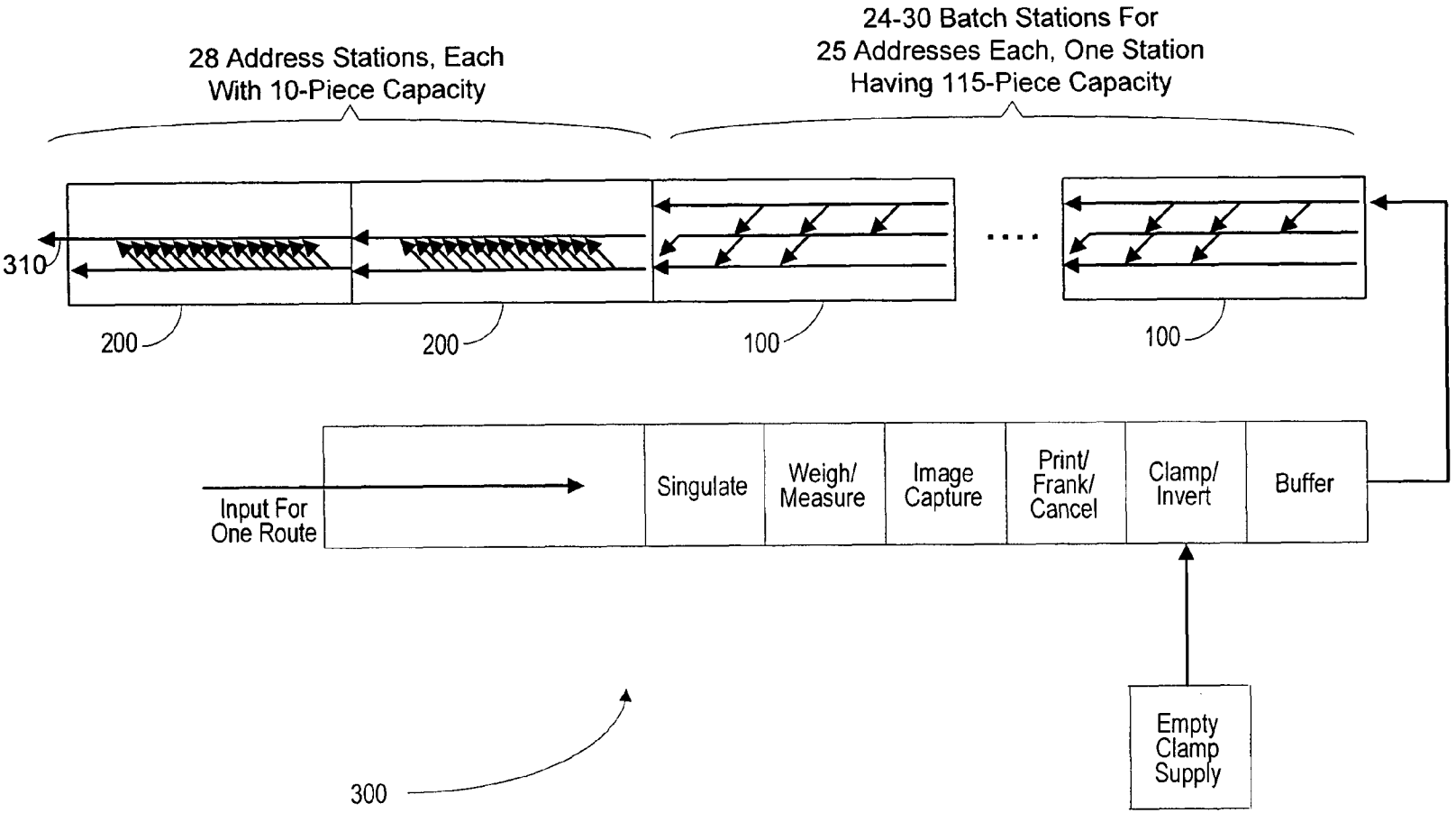
FIG. 3A shows a mail sorter according to an embodiment of the present invention, including batch sorting modules and address sorting modules.

As shown in FIG. 3A, the sorting configuration 300 in this embodiment of the invention assumes a number of the first type of modules (batch sorting modules 100) deployed in line, followed by one or more of the second type of modules (address sorting modules 200) also deployed in line with a final output 310. These modules can be deployed in any configuration: linear, racetrack, or stacked one on another to form a helical path through the sorter. For a typical installation in which one route's worth of mail consists of 1500 mail pieces to be delivered to 600 addresses, the preferred configuration will include ten of the first type of module 100 and two of the second type 200. With this configuration, a total of 30 batch stations will be included in the sorter to handle variations in route sizes. An average route will have 600 addresses. At 25 addresses per batch, we will need 600/25=24 batch stations.

By including the thirty batch stations, each capable of storing mail for 25 addresses, the sorter will be able to accommodate routes having up to 30×25=750 addresses. For average size routes, the extra batch stations can be used for overflow situations in which the amount of mail for any one batch of 25 addresses exceeds the storage capacity of one batch storage module. In this situation, one of the unused batch storage modules can be used to handle the overflow. This mail stored in the unused batch storage station will be joined with the mail from the originally assigned batch storage station while the batch sorted mail is being transported toward the address sorting modules.

By including the two address sorting modules 200 shown in FIG. 3A, for a total of 28 address locations, the sorter will be able to accommodate the situations in which any one address received more than 10 mail pieces on a given day. So, for example, if one address receives 25 mail pieces on a given day, the system controller will know this as soon as the batch sorting step is accomplished. So, the controller can assign two adjacent address' stations to accommodate this volume. Note that the address stations each need about 15 pitches (3 inches) of mail storage to be left open to insure that incoming mail pieces do not collide with the mail stored in the address station on either side of the mail input path. So when two adjacent stations are combined into a single address, the total capacity increases from 10 pieces to 35 pieces (2×10+15). Therefore, according to this embodiment of the invention, up to three addresses out of each batch of 25 can be configured to accommodate more than the maximum of 10 pieces per address.

As mentioned, the major cost of the sorter is found in the number of diverter assemblies. This is because each diverter contains an actuator to operate a diverting mechanism, a drive system to transport clamps from one transport to a storage transport, and another drive means to operate the storage transport intermittently whenever a mail piece is diverted. There are, of course, other costs to the sorter. But probably 80% of the costs of the sorting subsystems will be found in the diverter subsystems.

In the first configuration described above as related art, there were 80 diverters, and it took the sorter a total of 10 hours to sort 20 routes of mail. In the second configuration described above as related art, there were 800 diverters—which means the second configuration will cost roughly 10 times the cost of the first one. But it could sort 20 routes in approximately 2 hours. In contrast, the disclosed sorter configuration has a total of only 58 diverters: 30 for the batch sort modules, and 28 for the address sort modules. Therefore, the present embodiment of the invention will cost roughly a fourteenth the cost of the related art sorter having 800 diverters. Note that this analysis takes into account only the costs of the actual sorting operation, and does not include the costs for inputs and outputs to the sorter, which will be common to any of the above configurations.

To get a comparison of the approximate job time, for the 800-diverter system of the related art, as compared to the present embodiment of the invention, it is noted that the mail moves through the sorter path only one time. It is reasonable to assume that the speeds of the mail are the same in both systems (about 2"/sec). So, the job time for each system will be a function of the total path length (which is significantly different for the two systems), and the time to move the mail into the sorter (which is approximately the same for each type of sorter.) Note that equal efficiency is assumed in the input systems, and only those effects on job time are considered that are due to the total time it takes the mail to move through the entire sorter path. First, calculate the relative path lengths. For the 800-diverter system, each diverter and assignable address station requires a total of 5" of path length. The pitch of the clamps in the transport systems is 0.2". For each address storage station, about 3" is required to leave space to move new mail pieces into the address storage stations, and for storing 10 pieces at 0.2"/piece, another two inches is required for a total address station length of 5". Ergo, considering only the length of the address stations, a path length of 800×5=4000" will be required. If the sorter is configured so that the modules are stacked into ten tiers, then there will be an additional path length of 19 turn transports to connect the modules together into the helical path. Each of these turn modules will be approximately 50" long for an additional path length of 950", or a total path length of 4000+950=4950".

For the present embodiment of the invention, each of the address storage areas has the same 5" path length as above. So, this portion of the total path will be only 28 stations×5"=140" long. For the batch storage areas, each one is designed to store 115 mail pieces at the 0.2" pitch, plus the 3" space required to move the pieces into the storage area. The length of 30 batch storage stations will therefore be (115 pitches×0.2"/pitch+3")×30 stations=780". Thus the total path length will be 780"+140"=920". In addition, if these are arrayed in three tiers, then 5 turn modules at 50" each must be added. The total path length will be 920"+5×50"=1170".

The time to feed, clamp, and move the mail into the sorter will be the same for either configuration. If we assume the 20 routes of mail at 1500 pieces each, and the average thickness equal to 1.3 pitches, and the average input efficiency of 90%, then the length 20 route's worth of mail as it moves into the sorter will be 20×1500×0.2"×1.3/0.9=8667". Considering only these two path lengths, the total travel for the 800-diverter sorter will be 8667"+4950"=13,616". At 2"/sec transport speed, it will take 1.89 hours for the 20 routes of mail to move this distance. To calculate the number of routes that can be sorted in 2 hours, note that the only incremental time required will be the time to advance additional routes into the sorter at the following amount of time per route:

$$\frac{8667 \text{ inches}}{(20 \text{ routes})(2 \text{ inches/second})(3600 \text{ seconds per hour})} = 0.060 \text{ hours.}$$

So, about 22 routes of mail can be sorted in 2 hours. In contrast, for the present embodiment of the invention, the total path will be 8667"+1170"=9837". At 2 in/sec, it will take only 1.37 hours to move the 20 routes of mail this distance. There are 2.00−1.37=0.63 hours available for feeding additional routes into the sorter. In the time available, a total of 0.63/0.060=11 routes can be fed in, for a total of 31 routes in 2 hours. So, besides being about 14 times less expensive, the configuration of the present embodiment of the invention is also 41% more efficient than the 800-diverter sorter of the related art.

As an aside, the present embodiment is also less expensive than the simplest related-art sorter with only 80 diverters, discussed above. The present embodiment having only 58 diverters costs 58/80=73% of the 80-diverter configuration. Also, the 80-diverter configuration could sort only about 4 route's worth in 2 hours, whereas the new configuration of the present embodiment of the invention is 31/4=775% more efficient in processing mail.

The best number of addresses per batch appears to be 25, in order to achieve both the smallest number of inverters and the shortest overall path length through the sorter. This assumes 1.3 pitches per mail piece, and 25% excess capacity per storage station, without regard for how many total modules would be needed. However, it should be noted that there may be reason to increase or decrease that number (i.e. 25 addresses per batch) for other reasons.

Note that the algorithm described (i.e. sorting to batch, then sorting each batch to address) could be applied to conventional sorting systems, rather than just to clamp-based systems. For a route of 600 addresses, each receiving 2.5 mail pieces, the first phase could be to sort the 1500 pieces into 24 bins, each containing a batch of 25 addresses. So, a 50 bin conventional sorter could also use this disclosed algorithm, provided each of the first 24 bins were fitted with a means to re-feed the stacked mail pieces out of the bins and onto a transport that would advance them to an additional 25 bins further down stream. As each batch bin is re-fed and sorted to the 25 address bins, an operator would need to unload the 25 address bins in sequential order before the next batch of 25 could be sorted. Alternatively, the unload step could be automated.

The configuration shown in FIG. 3A does not explicitly show any mail pieces. However, FIGS. 3B-3H do show the configuration as mail pieces pass through the sorter.

Figure 3B:
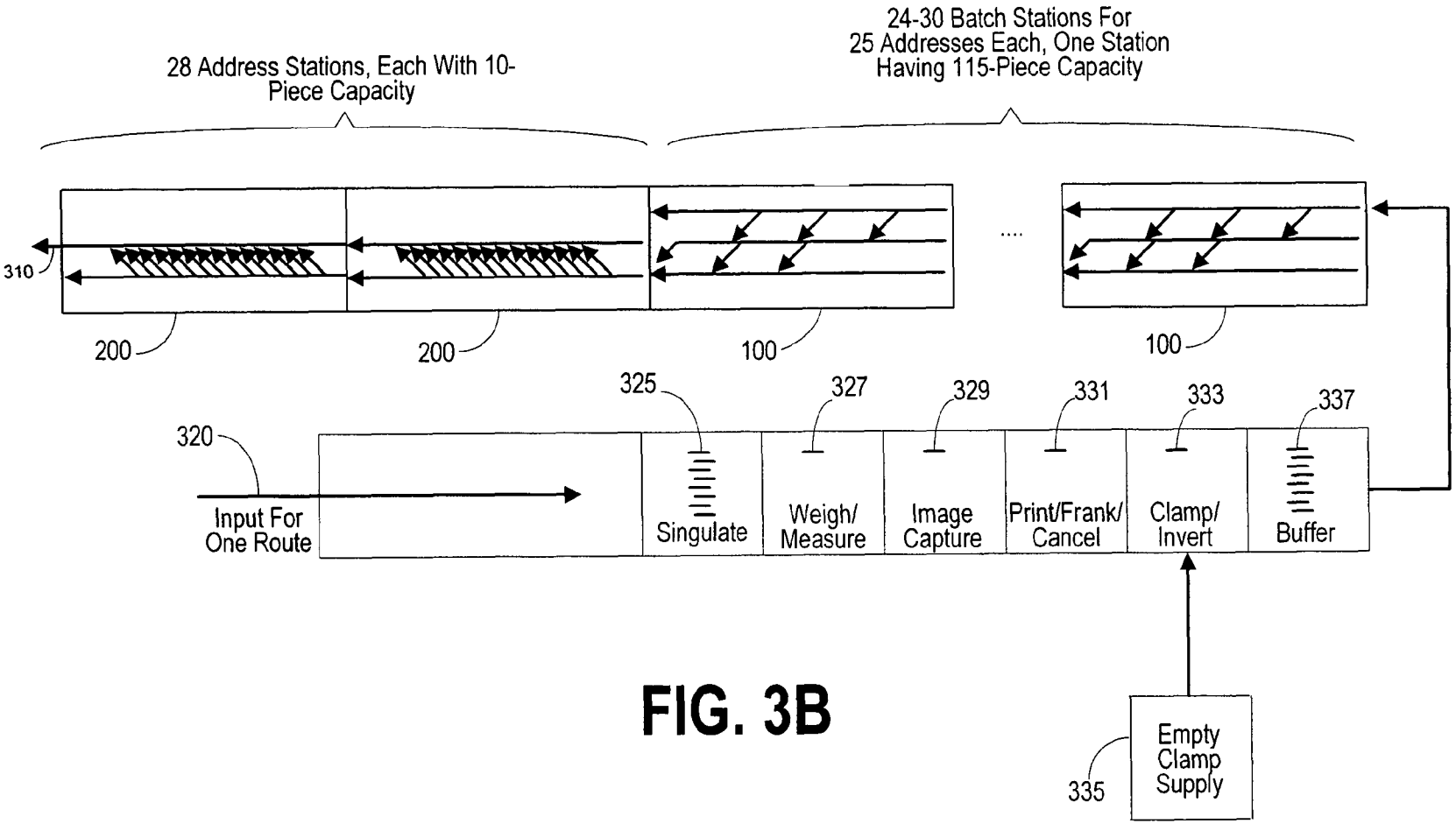
FIG. 3B shows the mail sorter of FIG. 3A with unsorted mail pieces being loaded.

Referring now to FIG. 3B, unsorted mail pieces for one route are provided as input 320 to the sorter. According to this embodiment of the invention, that would amount to 1500 mail pieces, and these mail pieces are shown 325 being singulated, shown 327 being weighed and/or measured, shown 329 having an image captured, shown 331 being printed/franked/cancelled, shown 333 being clamped and inverted (empty clamps are provided by a supply 335), and shown 337 being buffered.

Figure 3C:
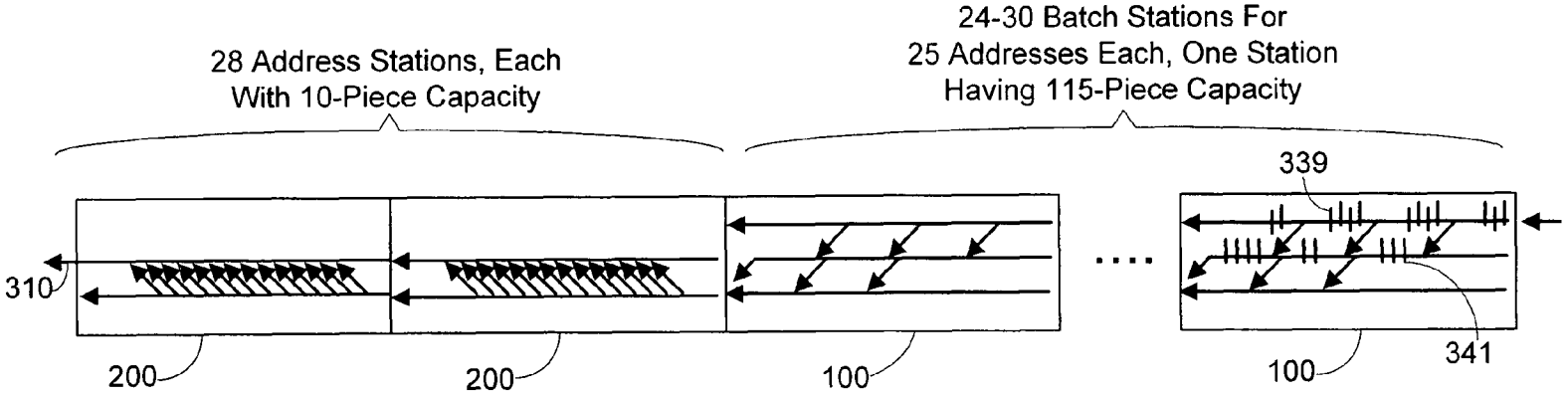
FIG. 3C shows the mail sorter of FIG. 3A with mail pieces being sorted to batches.
Figure 3D:
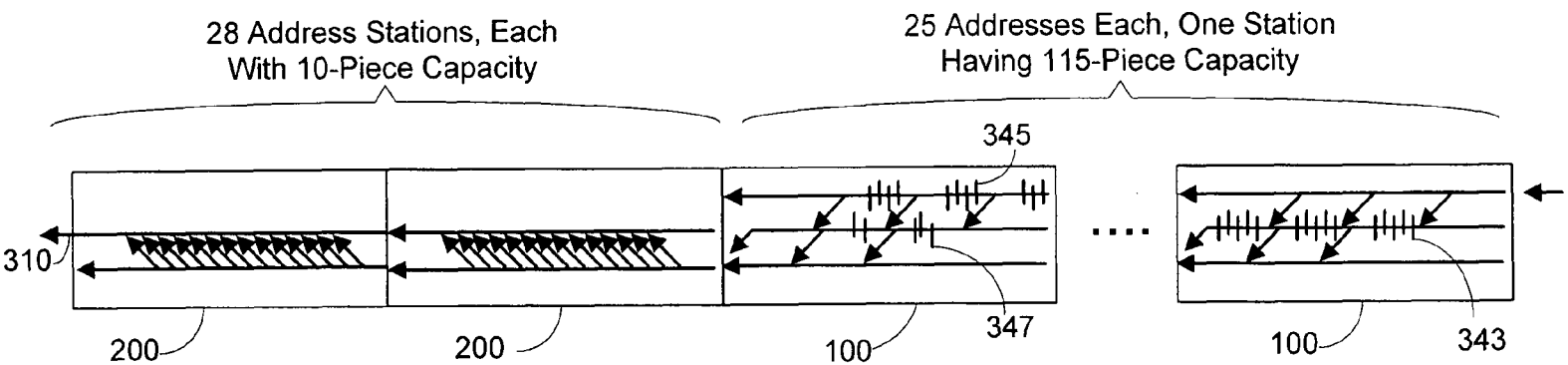
FIG. 3D shows the mail sorter of FIG. 3A with unsorted mail proceeding to be sorted in a second batch sorting module, once the first batch sorting module has finished sorting three batches.

FIG. 3C shows a portion of the configuration 300 of FIG. 3A. FIG. 3C shows unsorted mail pieces 339 that have been advanced into the sorter, and also shows some of those mail pieces 341 that are sorted according to batch (each batch covering 25 addresses). As seen in FIG. 3D, mail pieces are sorted into complete batches 343, and remaining unsorted mail pieces 345 are forwarded to a downstream batch sorting module where sorting into additional batches 347 occurs.

Figure 3E:
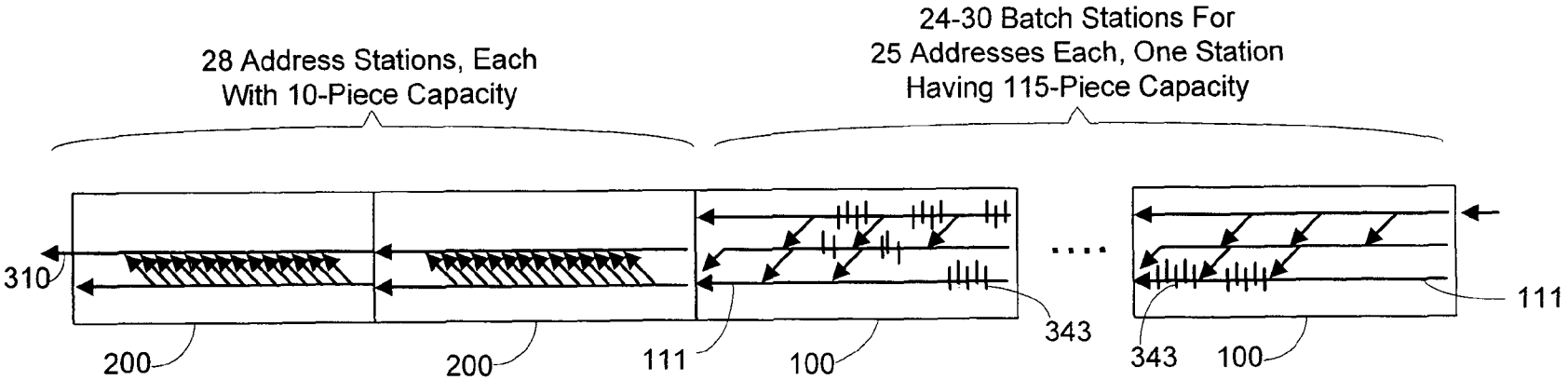
FIG. 3E shows the mail sorter of FIG. 3A with batches in the first batch sorting module being moved to an address sort module while the second batch sort module continues sorting.
Figure 3F:
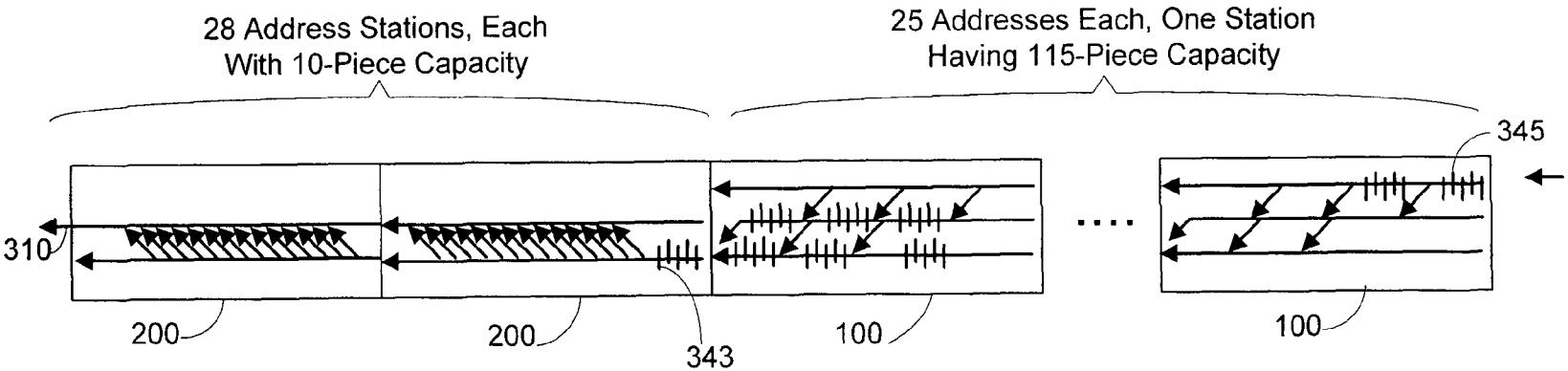
FIG. 3F shows the mail sorter of FIG. 3A with batches being moved to address sorting modules while the next route's mail moves into the first batch sorting module.

Turning now to FIG. 3E, the complete batches 343 are moved to the exit path (i.e. the third path for output 111), so that they can be transported downstream to the address sorting modules, as shown in FIG. 3F. Meanwhile, the next route's mail 345 enters the sorter.

Figure 3G:
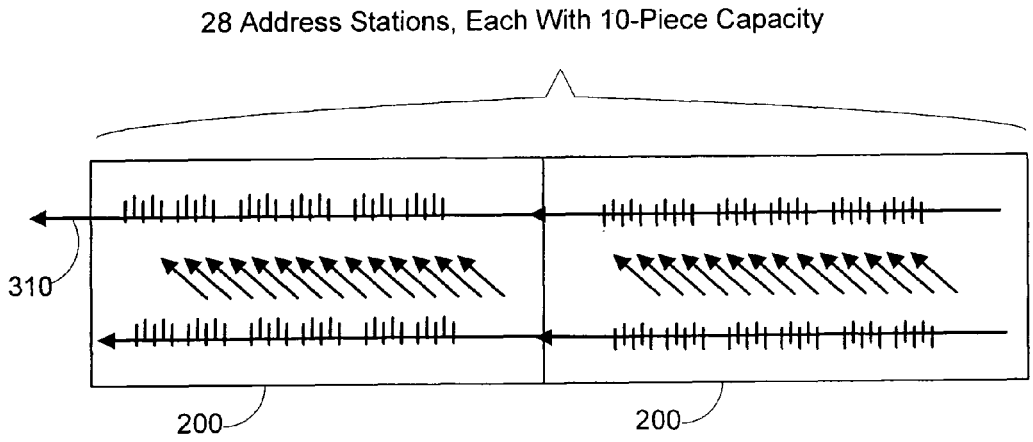
FIG. 3G is an enlarged view of the address sorting modules of FIG. 3A, with the batches being sorted to individual addresses.
Figure 3H:
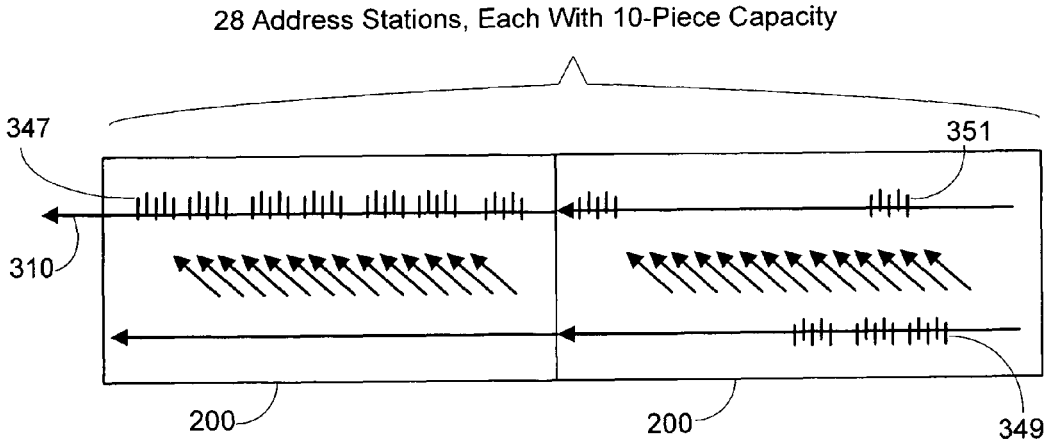
FIG. 3H is an enlarged view of the address sorting modules of FIG. 3A, with mail pieces that have been sorted to individual addresses being outputted, while an additional batch is entering the address sorting modules.

FIG. 3G is an enlarged view of the address sorting modules of FIG. 3F, with the batches being sorted to individual addresses. FIG. 3H then shows the mail pieces 347 that have been sorted to individual addresses being outputted, while an additional group of mail pieces 349 enters the address sorting modules to be sorted according to individual addresses into a final sequence 351.

Figure 4:
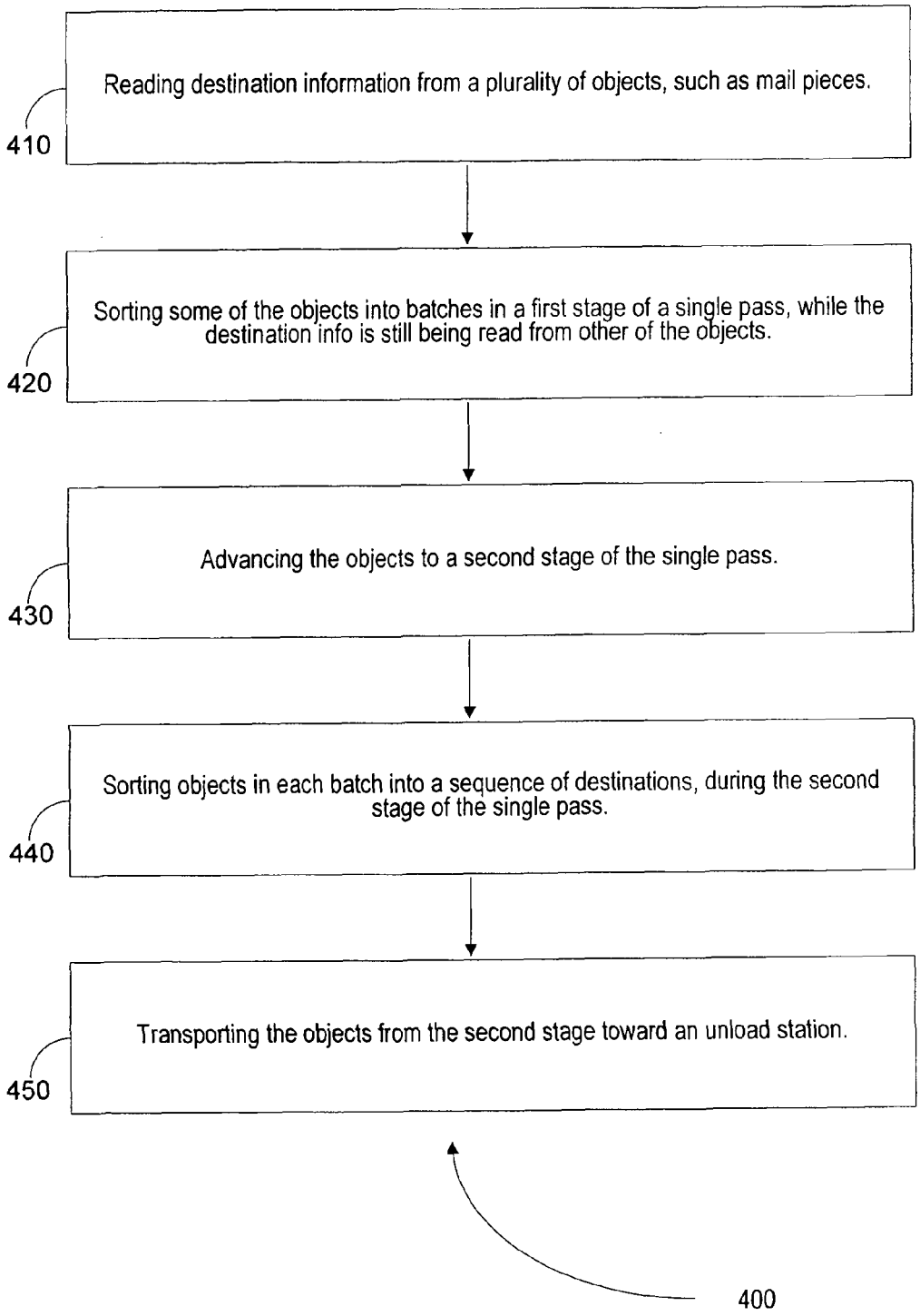
FIG. 4 is flow chart of a method according to an embodiment of the present invention.

A method 400 according to an embodiment of the present invention is shown by the flow chart in FIG. 4. First, destination information is read 410 from a plurality of objects, such as mail pieces. Then, at least some of the objects are sorted 420 into batches, during a first stage of a single pass, while the destination information is still being read from other of the objects (in the step 410). Subsequently, objects are advanced 430 to a second stage of the single pass. During the second stage of the single pass, objects in each batch are sorted 440 into a sequence of destinations. Finally, the objects are transported 450 from the second stage toward an unload station.

Figure 5:
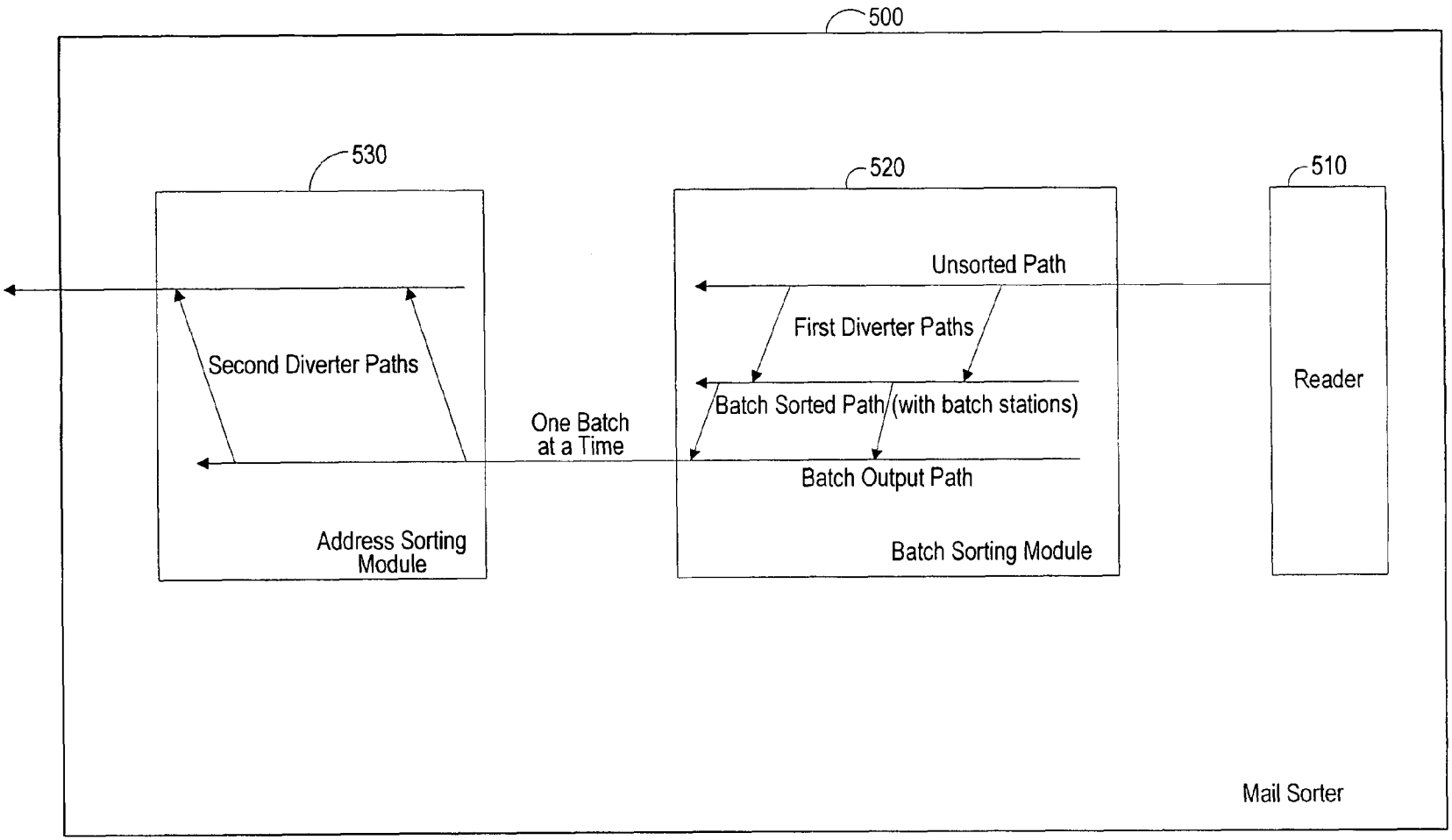
FIG. 5 is a simplified block diagram of a sorter according to an embodiment of the present invention.

FIG. 5 is a simplified block diagram of a sorter 500 according to an embodiment of the present invention. A reader 510 captures address information from each mail piece, and the mail pieces proceed along an unsorted path into a batch sorting module 520. First diverter paths are used to sort the mail pieces into batches, which are held in batch stations along a batch-sorted path. The batches leave the batch sorting module via a batch output path, which may be the same as either the unsorted path or the batch-sorted path, or may instead be another (third) path. In any event, the batches enter an address sorting module, one batch at a time. Then second diverter paths are used to sort the batches according to destination address, at which point the sorted mail pieces leave the sorter.

According to further embodiment of the present invention, the batch sorting modules will be designed with substantial excess storage capacity in order to handle all the mail for the addresses in each batch even on days when the volume of mail is higher than average. There may be times when the mail volumes are so heavy that even the excess storage capacity will be exceeded for some batch sorting stations. For this situation, additional overflow batch sorting stations are provided at a location between the batch sorting stations and the address sorting modules. If ever the volume of mail sorted to batch sorting stations exceeds the storage capacity of any of the batch sorting stations, an additional overflow batch sorting station will be assigned by the sorter controller to store the excess mail for the group of addresses in that batch. After the batch sorting step is complete, and the batch sorted mail is being transported from the batch sorting stations to the address sorting modules via the batch output path, the sorter controller will determine the number of mail pieces sorted to the overflow batch sort station, and leave a gap between the batch that exceeded the storage capacity and the next adjacent batch. The gap will be of sufficient size so that the mail sorted to the overflow batch station can be moved from the overflow batch sort station to the batch output path in gap between batches, thereby joining the overflow mail with the mail originally sorted to the batch station before the combined mail reaches the address sorting module.

Algorithms for implementing this integrated escort sorter can be realized using a general purpose or specific-use computer system, with standard operating system software conforming to the method described above. The software product is designed to drive the operation of the particular hardware of the system. A computer system for implementing this embodiment includes a CPU processor or controller, comprising a single processing unit, multiple processing units capable of parallel operation, or the CPU can be distributed across one or more processing units in one or more locations, e.g., on a client and server. The CPU may interact with a memory unit having any known type of data storage and/or transmission media, including magnetic media, optical media, random access memory (RAM), read-only memory (ROM), a data cache, a data object, etc. Moreover, similar to the CPU, the memory may reside at a single physical location, comprising one or more types of data storage, or be distributed across a plurality of physical systems in various forms.

It is to be understood that all of the present figures, and the accompanying narrative discussions of preferred embodiments, do not purport to be completely rigorous treatments of the methods and systems under consideration. A person skilled in the art will understand that the steps of the present application represent general cause-and-effect relationships that do not exclude intermediate interactions of various types, and will further understand that the various structures and mechanisms described in this application can be implemented by a variety of different combinations of hardware and software, and in various configurations which need not be further elaborated herein.

What is claimed is:

1. A method of sorting objects into a sequence of destination addresses, in a single pass through a sorter, the method comprising:

sorting the objects, in a first stage of the single pass, into a plurality of batches wherein each of the batches corresponds to a group of the destination addresses;

advancing the plurality of batches from the first stage to a second stage of the single pass; and further sorting the objects in each of the plurality of batches into the sequence of destination addresses during the second stage; wherein the objects are mail pieces held in clamps, and wherein the mail pieces are sorted by directly manipulating the clamps instead of by directly manipulating the mail pieces.

2. The method of claim 1, further comprising:

transporting the objects from the second stage toward at least one unload station.

3. The method of claim 1, wherein destination information is read from each of the objects prior to the sorting in the first stage; and wherein the sorting in the first stage of at least one of the objects begins while the destination information is read from at least one other of the objects.

4. The method of claim 1, wherein the sorting in the first stage includes diverting the objects from an unsorted path to a batch storage path, and wherein the sorting in the second stage includes diverting the objects from the batch storage path to a final sort path.

5. A method of sorting objects into a sequence of destination addresses, in a single pass through a sorter, the method comprising:

sorting the objects, in a first stage of the single pass, into a plurality of batches wherein each of the batches corresponds to a group of the destination addresses;

advancing the plurality of batches from the first stage to a second stage of the single pass; and further sorting the objects in each of the plurality of batches into the sequence of destination addresses during the second stage;

arranging a plurality of sorter modules in cooperative engagement with each other;

wherein the plurality of sorter modules includes at least one batch sorting module that receives the objects along an unsorted path, and that sorts the objects into the batches corresponding to the groups of destination addresses during the first stage sorting, wherein the batch sorting module includes at least one first diverter path that diverts the objects from the unsorted path to a batch storage path during the first stage sorting, wherein the plurality of sorter modules also includes at least one address sorting module that receives the batches from the at least one batch sorting module via a batch output path, and wherein the at least one address sorting module includes at least one second diverter path that diverts the objects from the batch output to a final sort output path during the second stage sorting to sort the objects into the sequence of destination addresses.

6. The method of claim 5, wherein the batch storage path is substantially located between the unsorted path and the batch output path.

7. The method of claim 5, wherein the unsorted path is converted to the batch output path once all of the objects have been diverted from the unsorted path.

8. A mail sorter for sorting mail pieces, the sorter comprising:

at least one batch sorting module configured to receive the mail pieces along an unsorted path, and configured to sort the mail pieces into batches corresponding to groups of destination addresses, wherein at least one first diverter path is arranged to divert the mail pieces from the unsorted path to a batch-sorted path; and at least one address sorting module configured to receive the batches, and sort the mail pieces in each of the batches according to the destination addresses, wherein the address sorting module performs the destination address sort one batch at a time; wherein the batch-sorted path comprises a plurality of batch stations, each of the batch stations holding the mail pieces destined for a predetermined number of consecutive destination addresses in a delivery sequence.

9. The mail sorter of claim 8, wherein a plurality of address sorting modules perform the destination sort for a corresponding plurality of batches at a time.

10. The mail sorter of claim 8, wherein a plurality of address sorting modules perform the destination sort for one of the batches at a time.

11. The mail sorter of claim 8, wherein a batch is received by the address sorting module after all of the mail pieces destined for the addresses corresponding to the batch have been sorted into the batch.

12. The mail sorter of claim 8, wherein the sorter is configured to assign more than one batch station to one of the batches when the number of mail pieces sorted to the one of the batches exceeds the maximum number of mail pieces for a batch station.

13. A mail sorter for sorting mail pieces, the sorter comprising:

at least one batch sorting module configured to receive the mail pieces along an unsorted path, and configured to sort the mail pieces into batches corresponding to groups of destination addresses, wherein at least one first diverter path is arranged to divert the mail pieces from the unsorted path to a batch-sorted path; and at least one address sorting module configured to receive the batches, and sort the mail pieces in each of the batches according to the destination addresses, wherein the address sorting module performs the destination address sort one batch at a time, wherein a batch is received by the address sorting module after all of the mail pieces destined for the addresses corresponding to the batch have been sorted into the batch, and wherein the address sorting module includes a number of second diverter paths that at least equals a maximum number of the destination addresses per batch.

14. A mail sorter for sorting mail pieces, the sorter comprising:

at least one batch sorting module configured to receive the mail pieces along an unsorted path, and configured to sort the mail pieces into batches corresponding to groups of destination addresses, wherein at least one first diverter path is arranged to divert the mail pieces from the unsorted path to a batch-sorted path; and at least one address sorting module configured to receive the batches, and sort the mail pieces in each of the batches according to the destination addresses, wherein the address sorting module performs the destination address sort one batch at a time, wherein a batch is received by the address sorting module after all of the mail pieces destined for the addresses corresponding to the batch have been sorted into the batch, and wherein the batch sorting module has a number of the first diverter paths that at least equals the ratio of a number of the destination addresses per delivery route divided by the number of destination addresses per batch.

15. The mail sorter of claim 8, further configured to allow each of the mail pieces to make a single pass through the sorter, wherein the single pass includes a first stage through the at least one batch sorting module, and a second stage through the at least one address sorting module.

16. The mail sorter of claim 15, further configured to transport each of the mail pieces out of the second stage.

17. The mail sorter of claim 15, further comprising:

a reader for automatically reading destination information from at least one of the mail pieces prior to the sorting in the first stage of the at least one of the mail pieces;

wherein the batch sorting module is configured to begin sorting the at least one of the mail pieces before the reader reads destination information from at least one other of the mail pieces.

18. A mail sorter for sorting mail pieces, the sorter comprising:

at least one batch sorting module configured to receive the mail pieces along an unsorted path, and configured to sort the mail pieces into batches corresponding to groups of destination addresses, wherein at least one first diverter path is arranged to divert the mail pieces from the unsorted path to a batch-sorted path; and at least one address sorting module configured to receive the batches, and sort the mail pieces in each of the batches according to the destination addresses, wherein the address sorting module performs the destination address sort one batch at a time, and wherein the mail pieces are held in clamps, and wherein the mail pieces are sorted by directly manipulating the clamps instead of by directly manipulating the mail pieces.

19. The mail sorter of claim 18, wherein clamps are transported on the unsorted path at a specified velocity, and the first diverter path is configured at an angle to the unsorted path, the clamp being transported on the diverter path at a velocity having two vector components, one of said vector components being parallel to the unsorted path and substantially equal to the specified velocity along the unsorted path.

20. The mail sorter of claim 8, wherein the batch-sorted path is substantially located between the unsorted path and a batch output path that provides the batches to the at least one address sorting module.

21. The mail sorter of claim 8, further configured to provide a batch output path to the address sorting module, wherein the batch output path is the unsorted path, or is the batch-sorted path, or is another path.

22. The mail sorter of claim 8, further configured to combine the mailpieces from the more than one batch stations assigned to the one of the batches prior to sorting at the address sorting module.

23. A software product for sorting objects into a sequence of destination addresses, in a single pass through a sorter, the software product comprising a computer readable storage medium comprising codes stored therein for execution by a processor, so that when executed the codes provide for:

sorting the objects, in a first stage of the single pass, into a plurality of batches wherein each of the batches corresponds to a group of the destination addresses;

advancing the plurality of batches from the first stage to a second stage of the single pass; and further sorting the objects in each of the plurality of batches into the sequence of destination addresses during the second stage; wherein the codes also provide for reading destination information from the objects prior to the first stage sorting; and wherein the codes also provide for beginning to sort, in the first stage, the objects, while the destination information is read from at least one other of the objects, and wherein the objects are mail pieces held in clamps, and wherein the mail pieces are sorted by directly manipulating the clamps instead of by directly manipulating the mail pieces.

24. The method of claim 1, wherein destination information is read from each of the objects prior to the sorting in the first stage of the single pass;

wherein the destination information of at least one of the objects is not yet read when sorting in the first stage of the single pass begins.

25. A method of sorting objects into a sequence of destination addresses, in a single pass through a sorter, the method comprising:

sorting the objects, in a first stage of the single pass, into a plurality of batches wherein each of the batches corresponds to a group of the destination addresses;

advancing the plurality of batches from the first stage to a second stage of the single pass; and further sorting the objects in each of the plurality of batches into the sequence of destination addresses during the second stage, wherein each of the objects comprises a holder and a mail piece held in the holder, and wherein the objects are sorted by directly manipulating the holders and not directly manipulating the mail pieces.

26. The method of claim 25, wherein all of the holders are substantially identical in shape.

27. A mail sorter for sorting mail pieces, the sorter comprising:

at least one batch sorting module configured to receive the mail pieces along an unsorted path, and configured to sort the mail pieces into batches corresponding to groups of destination addresses, wherein at least one first diverter path is arranged to divert the mail pieces from the unsorted path to a batch-sorted path;

at least one address sorting module configured to receive the batches, and sort the mail pieces in each of the batches according to the destination addresses, wherein the address sorting module performs the destination address sort one batch at a time; and holders for the mail pieces, and wherein the mail pieces are sorted by directly manipulating the holders and not directly manipulating the mail pieces.

28. The mail sorter of claim 27, wherein all of the holders are substantially identical in shape.

29. The software product of claim 23, wherein each of the objects comprises a holder and a mail piece held in the holder, and wherein the objects are sorted by directly manipulating the holders and not directly manipulating the mail pieces.

30. The software of claim 25, wherein all of the holders are substantially identical in shape.

* * * * *